US007026750B2

(12) United States Patent
Nishibayashi et al.

(10) Patent No.: US 7,026,750 B2
(45) Date of Patent: Apr. 11, 2006

(54) ELECTRON EMISSION ELEMENT

(75) Inventors: Yoshiki Nishibayashi, Itami (JP); Takahiro Imai, Itami (JP); Yutaka Ando, Sagamihara (JP)

(73) Assignees: Sumitomo Electric Industries, Ltd., Osaka (JP); Japan Fine Ceramics Center, Aichi (JP)

( * ) Notice: Subject to any disclaimer, the term of this patent is extended or adjusted under 35 U.S.C. 154(b) by 248 days.

(21) Appl. No.: 10/667,149

(22) Filed: Sep. 22, 2003

(65) Prior Publication Data

US 2004/0095051 A1 May 20, 2004

(30) Foreign Application Priority Data

Sep. 20, 2002 (JP) ..... P2002-276423

(51) Int. Cl.
*H01J 1/14* (2006.01)

(52) U.S. Cl. ..... 313/346 R; 313/336; 313/351; 313/357

(58) Field of Classification Search ..... 313/309, 313/336, 351, 346 R
See application file for complete search history.

(56) References Cited

U.S. PATENT DOCUMENTS 5,583,393 A * 12/1996 Jones ..... 313/495
5,844,252 A * 12/1998 Shiomi et al. ..... 257/10
5,891,321 A * 4/1999 Bernhardt ..... 205/664
6,069,018 A * 5/2000 Song et al. ..... 438/20
6,184,611 B1 * 2/2001 Saito et al. ..... 313/310
6,268,229 B1 * 7/2001 Brandes et al. ..... 438/20
2002/0031913 A1 3/2002 Nishibayashi et al.

FOREIGN PATENT DOCUMENTS

JP P2001-266736 A 9/2001
JP P2002-75171 A 3/2002

* cited by examiner

*Primary Examiner*—Nimeshkumar D. Patel
*Assistant Examiner*—German Colón
(74) *Attorney, Agent, or Firm*—McDermott Will & Emery LLP

(57) ABSTRACT

An electron emission element of the present invention comprises a substrate, and a protrusion protruding from the substrate and including boron-doped diamond. The protrusion comprises a columnar body. And a tip portion of the protrusion comprises an acicular body sticking out therefrom. The distance r [cm] between a center axis and a side face in the columnar body and the boron concentration Nb [$cm^{-3}$] in the diamond satisfy the relationship represented by the following formula (1):

$$r > \frac{10^4}{\sqrt{Nb}}. \quad (1)$$

7 Claims, 4 Drawing Sheets

ELECTRON EMISSION ELEMENT

BACKGROUND OF THE INVENTION

1. Field of the Invention

The present invention relates to an electron emission element including diamond.

2. Related Background Art

Conventional electron emission elements including diamond have been doped with boron having a low acceptor level in order to enhance the conductivity of the diamond. Many of such electron emission elements including boron-doped diamond have been formed with an acute part on the tip in order to draw electrons at a low voltage.

SUMMARY OF THE INVENTION

Conventional electron emission elements described above has been problematic in that electron emission efficiency decrease as the acute part become sharper. The reason why such a problem occurs has not been understood well. This is because of the fact that, though electric fields in vacuum determined by the tip portion of the electron emission element where electrons are emitted and the anode have been evaluated so far, electric fields within the tip portion have not been taken into consideration yet.

In view of the problem mentioned above, it is an object of the present invention to provide an electron emission element including boron-doped diamond that exhibits excellent electron emission efficiency.

For overcoming the above-mentioned problem, the present invention provides an electron emission element comprising a substrate, and a protrusion protruding from the substrate and including boron-doped diamond: the protrusion comprising a columnar body; a tip portion of the protrusion comprising an acicular body sticking out therefrom; and the distance r [cm] between a center axis and a side face in the columnar body and the boron concentration Nb [$cm^{-3}$] in the diamond satisfying the relationship represented by the following formula (1):

$$r > \frac{10^4}{\sqrt{Nb}}. \tag{1}$$

The inventor has found that a depletion layer of an electron-emitting part widens when a negative voltage is applied to the electron emission element and the conductivity of the electron-emitting part decreases, and consequently the electron emission efficiency deteriorates since no strong electric fields are exerted on the electron-emitting part. Satisfying the above-mentioned formula (1) secures a carrier layer within the columnar body, thereby improving the electron emission efficiency. Note that if the columnar body has a tapered form, r is defined as the distance between the center axis and side face at a boundary with a substrate.

Preferably, in the electron emission element in accordance with the present invention, the distance between the center axis and side face in the columnar body is 0.1 μm or less, whereas the boron concentration in the diamond is at least $5\times 10^{19}$ $cm^{-3}$.

The electron emission element having a boron concentration of at least $5\times10^{19}$ $cm^{-3}$ yields a higher electron emission efficiency as the columnar body is thinner.

For overcoming the above-mentioned problem, the present invention provides an electron emission element comprising a substrate, and a protrusion protruding from the substrate and including boron-doped diamond: the protrusion comprising a columnar body; a tip portion of the protrusion comprising an acicular body sticking out therefrom; diamond crystal included in the tip portion of the protrusion being terminated with hydrogen; and the distance r [cm] between a center axis and a side face in the columnar body and the boron concentration Nb [$cm^{-3}$] in the diamond satisfying the relationship represented by the following formula (2):

$$r > \frac{10^2}{\sqrt{Nb}}. \tag{2}$$

When the exposed surface of the tip portion composed of diamond crystal is terminated with hydrogen, the electron affinity becomes smaller (negative), and the surface becomes p type, which has the same effect as in the case of increasing the boron concentration, whereby the depletion layer becomes thinner, thus making it easier to emit electrons.

Preferably, in the electron emission element in accordance with the present invention, the diamond is doped with nitrogen, whereas the boron concentration Nb [$cm^{-3}$] in the diamond is higher than the nitrogen concentration Nn [$cm^{-3}$] therein.

Preferably, in the electron emission element in accordance with the present invention, the diamond is doped with nitrogen, whereas the boron concentration Nb [$cm^{-3}$] and nitrogen concentration Nn [$cm^{-3}$] in the diamond satisfy the relationship represented by the following formula (3):

$$Nb-Nn<6\times10^{18} \tag{3}$$

When doped with nitrogen, the electron emission element further improves the electron emission efficiency. In particular, the electron emission efficiency has been found to become the highest when the nitrogen concentration Nn [$cm^{-3}$] satisfies the condition of the above-mentioned expression (3).

Preferably, in the electron emission element in accordance with the present invention, the protrusion protrudes from a (111) sector of a diamond formed by a high pressure-high temperature synthesis.

The electron emission efficiency has been found to become the most excellent when the (111) sector is employed as the protrusion.

Preferably, in the electron emission element in accordance with the present invention, the protrusion, when terminated with hydrogen, protrudes from a (311) or (110) sector of a diamond formed by a high pressure-high temperature synthesis.

The electron emission efficiency has been found to be the most excellent when the (311) or (110) sector is employed as the protrusion in the case of hydrogen termination.

Preferably, in the electron emission element in accordance with the present invention, the substrate is diamond formed by a vapor-phase synthesis.

A diamond containing boron can easily be formed by a vapor-phase synthesis.

DESCRIPTION OF THE PREFERRED EMBODIMENTS

In the following, preferred embodiments of the present invention will be explained in detail with reference to the accompanying drawings.

Figure 1B:
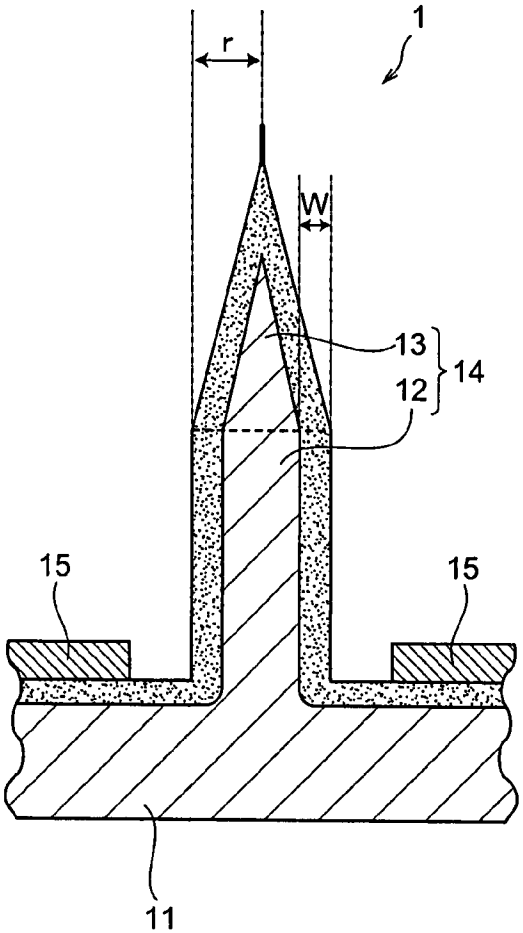
FIG. 1B is a longitudinal sectional view of an electron emission element 1 where the radius r of the columnar part is larger than the length of the depletion layer.
Figure 1A:
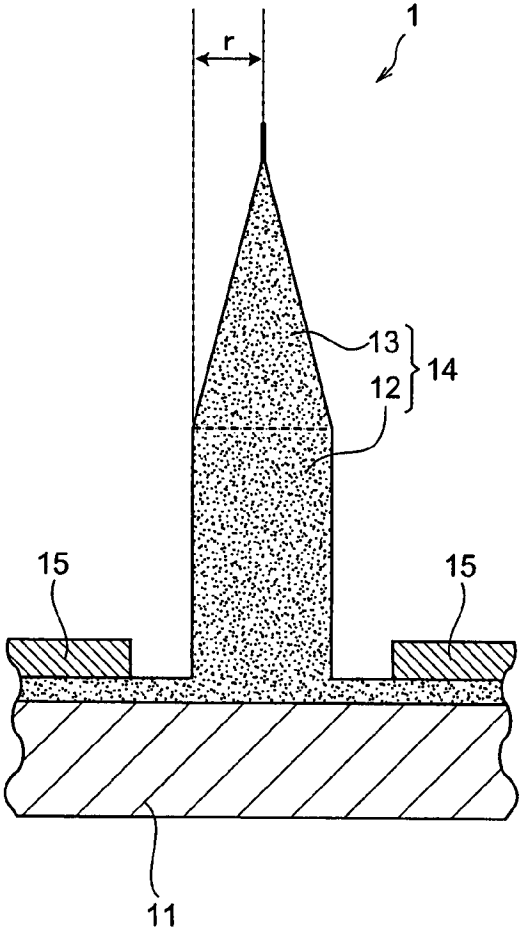
FIG. 1A is a longitudinal sectional view of an electron emission element 1 where the radius r of the columnar part is smaller than the length of the depletion layer.

The structure of an electron emission element 1 in accordance with an embodiment will be explained. FIGS. 1A and 1B are longitudinal sectional view of the electron emission element 1. The electron emission element 1 comprises a substrate 11 made of diamond, whereas a protrusion 14 of the diamond protrudes from the substrate 11. A columnar part 12 constituting the lower part of the protrusion 14 is formed like a circular cylinder having a side face substantially perpendicular to the surface of the substrate 11. The upper part of the protrusion 14 is constituted by an acute part 13 comprising a needle at the leading end. Electrons are emitted from this needle.

The diamond constituting the protrusion 14 and substrate 11 is doped with boron (by a vapor-phase synthesis, thermal diffusion, ion implantation, etc.), so as to become electrically conductive.

The radius r [cm] of the columnar part 12 and the boron concentration Nb [$cm^{-3}$] therein satisfy the relationship represented by the following formula (1):

$$r > \frac{10^4}{\sqrt{Nb}} \tag{1}$$

Formed on the surface of the substrate 11 is a cathode electrode film 15 made of Al. The cathode electrode film may be formed on the rear side of the substrate 11.

Above the electron emission element 1, an anode electrode A (not depicted) is disposed so as to oppose the acute part 13. When a negative voltage is applied to the cathode electrode film 15, an electron is supplied from the cathode electrode film 15 to the protrusion 14 by way of the substrate 11. The electron having reached the leading end of the needle in the acute part 13 is emitted to the outside by the electric field between the needle-shaped leading end and the anode electrode A.

Operations/effects of the electron emission element 1 will now be explained. When a negative voltage is applied to the cathode electrode film 15, a depletion layer spreads into inside the acute part 13 and columnar part 12 from their surfaces, while electrons emitted from the electron-emitting part increase. The thickness of the depletion layer stabilizes at certain length, as current value of emitted electrons stabilizes. The thickness w [cm] of the depletion layer at this time is represented by the right side of the above-mentioned expression (1).

The theoretical value of the thickness W [cm] is represented by the following formula (4) using the boron concentration Nb [$cm^{-3}$] as parameters on the assumption that the voltage [V] between the surface of the protrusion 14 and cathode electrode film 15 approximates 1V. It is seen from this expression that a carrier layer is secured within the columnar body on condition that the distance r [cm] between the center axis and side face of the columnar body is greater than the thickness of the depletion layer. Since the carrier layer is at the same potential as with the substrate, an equipotential surface deforms at the leading end of the protrusion 14, whereby a high electric field is exerted on the leading end. While such a condition is maintained, electron emission begins if a high electric field exceeding a threshold voltage $V_0$ enabling the electron emission is exerted. Then, the depletion layer hardly expands anymore, whereby electrons continue to be emitted at higher voltages. If the depletion layer exceeds the distance r before the voltage reaches $V_0$, so that no carrier layer exists in the columnar body, the equipotential surface approaches the substrate surface and becomes nearly parallel thereto. In this case, though a high voltage is applied, the equipotential surface does not deform so much in the vicinity of the protrusion, whereby the electron emission may not be achieved notwithstanding the high electric field required for electron emission. Therefore, it is important to satisfy the formula (4). A constant of the formula (1) has empirically been determined according to such a principle, and the electron emission efficiency has been found to improve if the distance r [cm] between the center axis and side face in the columnar body and the boron concentration Nb [$cm^{-3}$] therein satisfy the above-mentioned expression (1).

$$r > w \approx \sqrt{\frac{2\varepsilon}{qNb}} \tag{4}$$

where $\epsilon$ is the dielectric constant [F/m] of the diamond; and q is the elementary electric charge [C].

FIG. 1A shows a case where the radius r of the columnar part 12 is set smaller than the thickness w of the depletion layer. In this case, the whole inside of the columnar part 12 is covered with the depletion layer, whereby electrons are kept from being supplied to the electron-emitting part.

FIG. 1B shows a case where the radius r of the columnar part 12 is set greater than the thickness w of the depletion layer. In this case, the carrier layer remains in the center part of the columnar part 12, whereas electrons are supplied to the electron-emitting part by way of the carrier layer. This improves the electron emission efficiency.

Table 1 shows electron emission characteristics (whether electrons were emitted or not being indicated by O and X, respectively, when a voltage of 2 kV was applied) in respective cases where the radius r of the columnar part 12 was 0.2 μm, 0.15 μm, 0.05 μm and 0.02 μm when the exposed surface of the acute part 13 was not terminated with hydrogen.

TABLE 1

| Nb | Characteristic at r = 0.2 μm | Characteristic at r = 0.15 μm | Characteristic at r = 0.05 μm | Characteristic at r = 0.02 μm |
|---|---|---|---|---|
| $10^{17}$ $cm^{-3}$ | X | X | X | X |
| $10^{18}$ $cm^{-3}$ | ○ | ○ | X | X |
| $10^{19}$ $cm^{-3}$ | ○ | ○ | ○ | X |
| $10^{20}$ $cm^{-3}$ | ○ | ○ | ○ | ○ |

As shown in Table 1, in the case where the boron concentration Nb was $10^{18}$ $cm^{-3}$, electrons were emitted only when the radius r of the columnar part 12 was 0.15 μm or more exceeding the theory value 0.01 μm of the depletion layer according to the formula (1). Further, in the case where the boron concentration Nb was $10^{19}$ $cm^{-3}$, electrons were emitted only when the radius r of the columnar part 12 was 0.05 μm or more exceeding the theory value 0.032 μm of the depletion layer according to the formula (1).

Figure 4A:
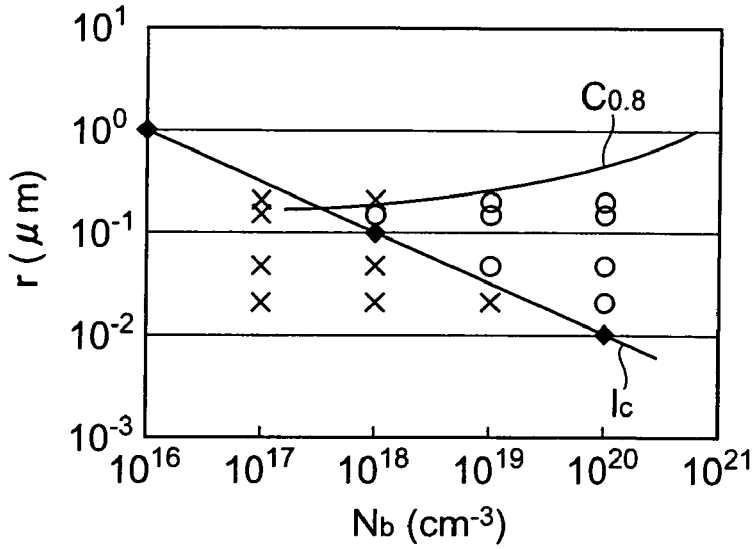
FIGS. 4A–4C are logarithmic graphs that show electron emission characteristics where voltages of 800V, 2 kV and 3 kV are applied to the electron emission element 1, respectively.
Figure 4B:
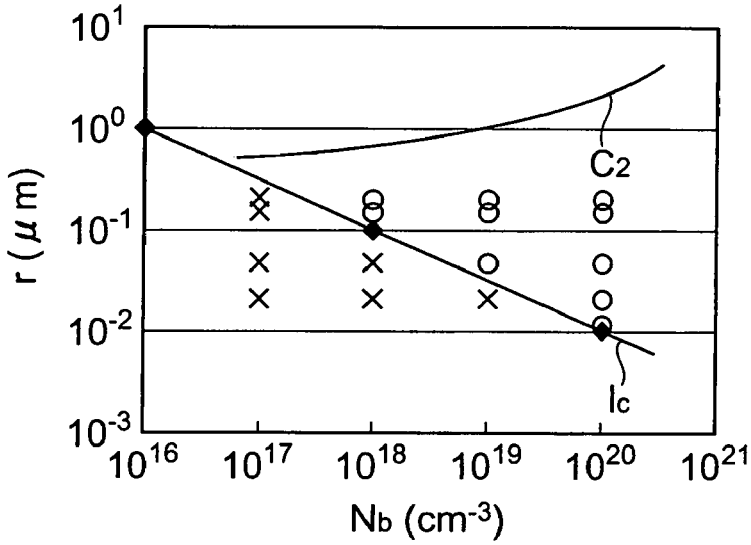
Figure 4C:
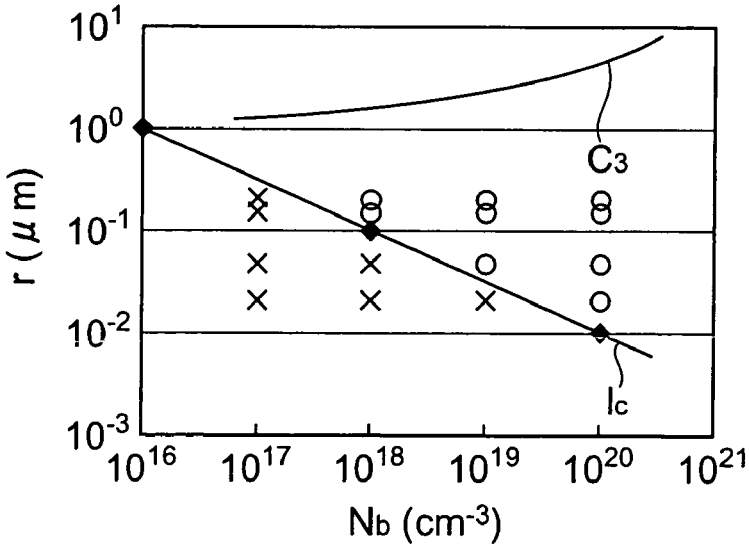

FIGS. 4A–4C are logarithmic graphs that show electron emission characteristics where voltages of 800V, 2 kV and 3 kV are applied to the electron emission element 1, respectively. In FIGS. 4A–4C, marks O indicate the result in which electrons were emitted and marks X indicate the result in which electron emission could not be emitted at respective observation conditions. And in each of FIGS. 4A–4C, line $l_c$ indicates the critical line where the radius r of the columnar part 12 equals the theory value of the thickness of the depletion layer according to the formula (1).

As shown in FIGS. 4A–4C electrons were emitted on the conditions above the critical line $l_c$, namely on the conditions where the radius r of the columnar part 12 is greater than the theoretical thickness of the depletion layer, regardless of the voltage applied around favorable voltage of 2 kV.

These results prove that the electron emission efficiency improves when the radius r is made greater than the theoretical thickness of the depletion layer. From the other perspective, these results indicate that when the radius r is held constant electrons are more likely to be emitted as the boron concentration Nb is made higher so that the thickness of the depletion layer is smaller than the radius r.

Further to the above-mentioned results, it was found that electrons were emitted only when the radius r was made adequately smaller relative to the voltage applied. In FIGS. 4A–4C, curved lines $c_{0.8}$, $c_2$, and $c_3$ indicate the critical value of the radius r below which electrons were emitted in case where voltages of 800V, 2 kV and 3 kV are applied, respectively.

Table 2 shows electron emission characteristics (the occurrence of electron emission upon application of a voltage of 1 kV or less being indicated by ○, whereas the occurrence of electron emission upon application of a voltage of 2 kV or less being indicated by Δ) in respective cases where the radius r of the columnar part 12 was 0.2 μm, 0.15 μm, 0.05 μm and 0.02 μm when the exposed surface of the acute part 13 was terminated with hydrogen.

TABLE 2

| Nb | Characteristic at 0.2 μm | Characteristic at 0.15 μm | Characteristic at 0.05 μm | Characteristic at 0.02 μm |
|---|---|---|---|---|
| $10^{15}$ $cm^{-3}$ | Δ | Δ | Δ | Δ |
| $10^{16}$ $cm^{-3}$ | ○ | ○ | Δ | Δ |
| $10^{17}$ $cm^{-3}$ | ○ | ○ | ○ | Δ |
| $10^{18}$ $cm^{-3}$ | ○ | ○ | ○ | ○ |

The facts verified by Table 1 are also deducible from Table 2. In addition, Table 2 indicates that the boron concentration, where a specific thickness of depletion layer is formed, decreases, in other ward the depletion layer becomes thinner at a specific boron concentration, when the exposed surface of the acute part 13 is terminated with hydrogen

EXAMPLES

Details of the present invention will be explained more specifically with reference to examples, which do not restrict the present invention.

Example 1

A monocrystal diamond (100) substrate containing boron, produced by a high pressure-high temperature synthesis, was prepared. An Al film was vapor-deposited on the monocrystal diamond (100) substrate, and a fine dotted mask of Al was produced by using a photolithography technique. Subsequently, using an RIE technique, the monocrystal diamond (100) substrate was subjected to reactive ion etching within a $CF_4/O_2$ gas (having a $CF_4$ concentration of 1%) at a pressure of 2 Pa and a power of 200 W without heating the substrate. Minute cylindrical columns having a desirable height (3 to 6 μm) were formed by etching for 0.5 to 1 hour.

After removing Al, the minute cylindrical columns were exposed to a microwave plasma of a $CO_2/H_2$ gas (having a $CO_2$ concentration of 0.5% to 2%) at a power of 400 W, a substrate temperature of 1050° C., and a pressure of 100 Torr, so as to form a needle(s) on each tip of the minute cylindrical column.

Figure 2:
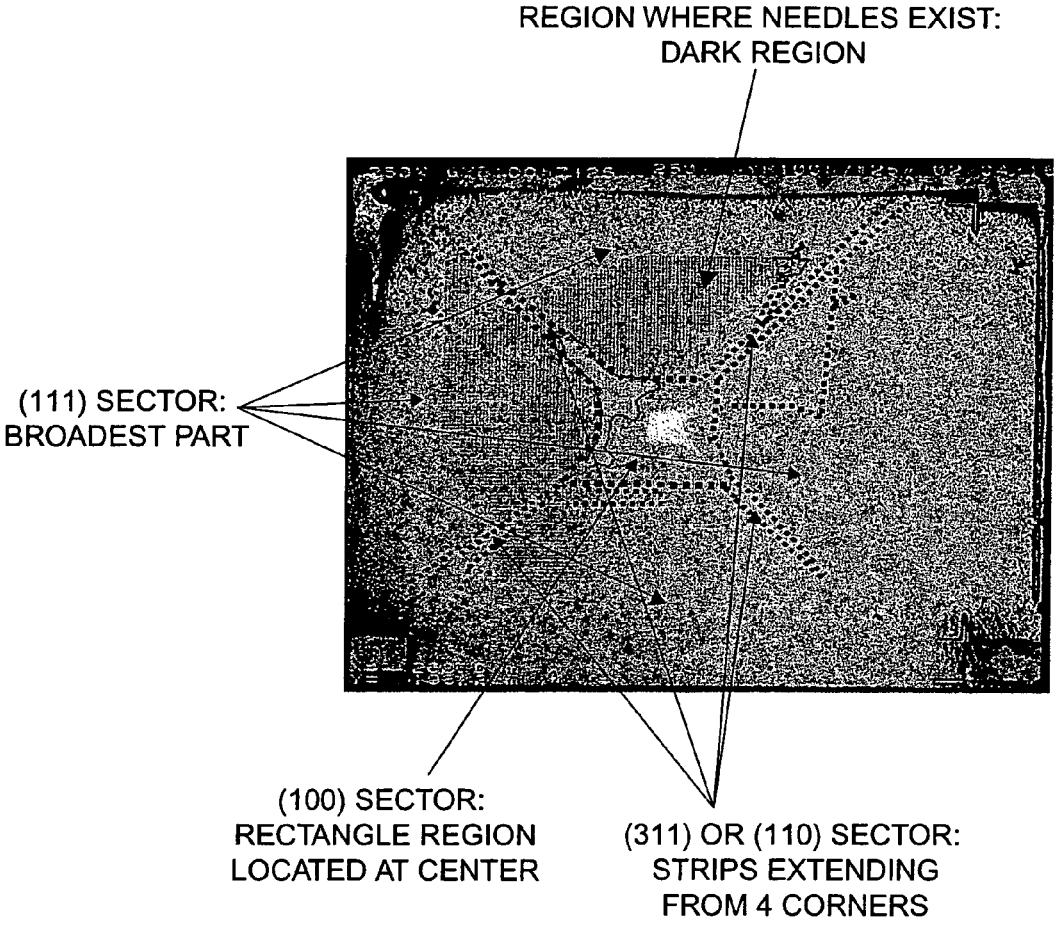
FIG. 2 is a view showing the configuration of an exposed surface of a substrate in Example 1.

FIG. 2 shows the configuration of the exposed surface of the substrate. The electron emission characteristic was evaluated at each location of the substrate where the protrusions were formed in thus obtained sample. As a result, it has been verified that electrons are emitted from parts where the needle exists, favorably from (111) sectors in particular.

Figure 3:
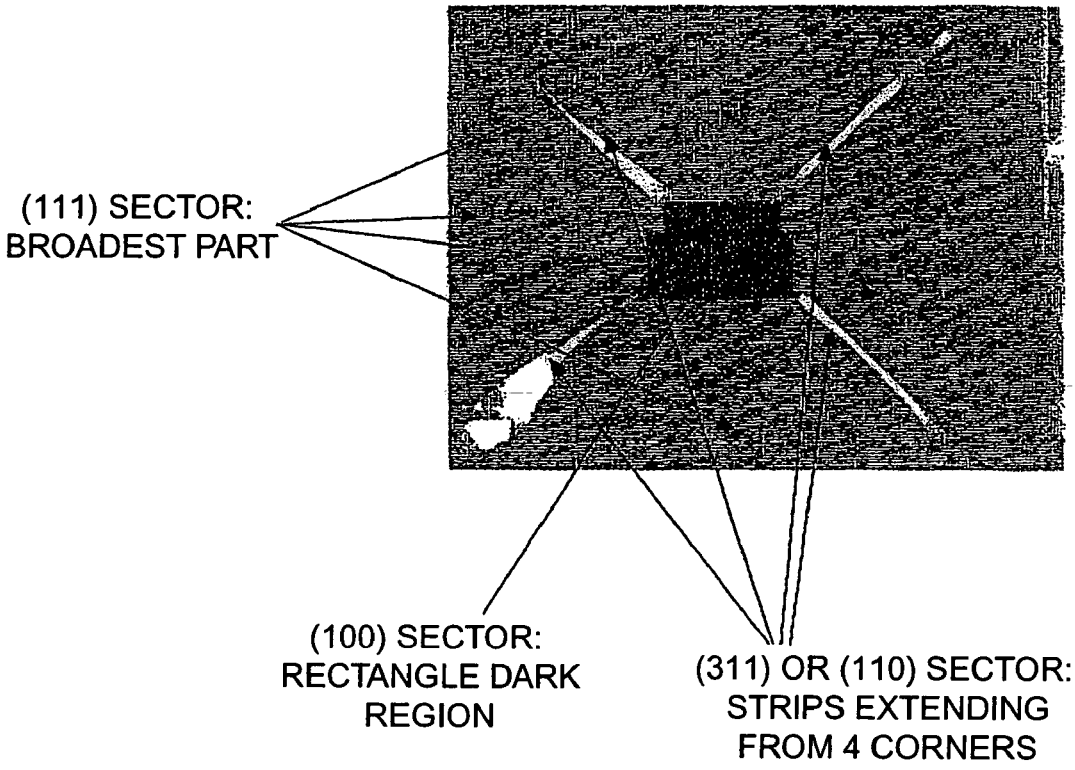
FIG. 3 is a view showing the configuration of an exposed surface of a substrate from which hydrogen-terminated protrusions are protruding in Example 1.

FIG. 3 shows the configuration of an exposed surface of a substrate from which hydrogen-terminated protrusions are protruding. After producing the electron emission element having a hydrogen-terminated exposed surface of the acute part, the electron emission characteristic was evaluated at each location of the substrate where the protrusions were formed. As a result, it has been verified that electrons are emitted from parts where the needle exists, favorably from (311) and (110) sectors in particular.

Configuration of the exposed surface of the substrate like those shown in FIGS. 2 and 3 can be obtained by selecting the location to be cut out for the substrate in the diamond formed by the high pressure-high temperature synthesis method. For example, the configuration shown in FIG. 3 can be obtained by cutting out to make a substrate the area containing large parts of (311) sector or (110) sector in the synthetic diamond.

Example 2

Using a monocrystal diamond substrate containing boron and nitrogen produced by a high pressure-high temperature synthesis, an electron emission element was formed. When the electron emission characteristic of this sample was evaluated, electron emission was hardly seen. The nitrogen concentration was higher than the boron concentration.

Example 3

Using a monocrystal diamond substrate containing boron and nitrogen produced by a high pressure-high temperature synthesis, electron emission elements comprising a needle formed at a (111) sector were made.

When the relationship between the electron emission characteristic and the boron and nitrogen concentrations was evaluated, samples containing at least $10^{19}$ to $10^{20}cm^{-3}$ of boron along with nitrogen mixed therein were found to exhibit better characteristics.

Table 3 shows the relationship between the nitrogen concentration and threshold value in electron emission elements having a boron concentration of $1\times10^{19}$ $cm^{-3}$ and $5\times10^{19}$ $cm^{-3}$.

TABLE 3

| B conc. ($cm^{-3}$) | N conc. ($cm^{-3}$) | Threshold voltage (V) |
|---|---|---|
| $1 \times 10^{19}$ | $2 \times 10^{19}$ | >3000 |
| $1 \times 10^{19}$ | $5 \times 10^{18}$ | 800 |

TABLE 3-continued

| B conc. ($cm^{-3}$) | N conc. ($cm^{-3}$) | Threshold voltage (V) |
|---|---|---|
| $1 \times 10^{19}$ | $4 \times 10^{18}$ | 900 |
| $1 \times 10^{19}$ | $3 \times 10^{18}$ | 1300 |
| $1 \times 10^{19}$ | $1 \times 10^{18}$ | 1400 |
| $1 \times 10^{19}$ | $5 \times 10^{17}$ | 1900 |
| $5 \times 10^{19}$ | $45 \times 10^{18}$ | 700 |
| $5 \times 10^{19}$ | $44 \times 10^{18}$ | 800 |
| $5 \times 10^{19}$ | $43 \times 10^{18}$ | 1100 |

$2 \times 10^{19}$ $cm^{-3}$ = 100 ppm

As shown in Table 3, the threshold voltage sharply increased when the nitrogen concentration was lowered from $4\times10^{18}$ $cm^{-3}$ to $3\times10^{18}$ $cm^{-3}$ in case where the boron concentration was $1\times10^{19}$ $cm^{-3}$. Similarly, the threshold voltage sharply increased when the nitrogen concentration was lowered from $44\times10^{18}$ $cm^{-3}$ to $43\times10^{18}$ $cm^{-3}$ in case where the boron concentration was $5\times10^{19}$ $cm^{-3}$.

These results support the fact that the threshold voltage is low when the difference between the boron concentration and nitrogen concentration is at or lower than $6\times10^{18}$ $cm^{-3}$. In other word, electron emission becomes efficient when the formula (3) is satisfied.

Further to the above-mentioned results, it is seen from Table 3 that threshold voltage becomes extremely high when the nitrogen concentration exceeds the boron concentration.

Example 4

A monocrystal diamond substrate produced by a vapor-phase synthesis was formed with a boron-doped layer. Using this product, an electron emission element (having a boron content of about $5\times10^{19}$ $cm^{-3}$) was made.

The electron emission characteristic was evaluated and found to be better as the radius of the columnar part was shorter. On the other hand, an electron emission element having a very thin columnar part (with a radius of 0.1 μm or less) and a boron concentration of $5\times10^{19}$ $cm^{-3}$ or less was produced but failed to yield favorable results upon evaluation.

Table 4 shows the relationship between boron concentration and threshold voltage in the electron emission element having a very thin columnar part (with a radius of 0.1 μm or less).

TABLE 4

| Conc. ($cm^{-3}$) | Threshold voltage (V) |
|---|---|
| $10^{20}$ | 700 |
| $5 \times 10^{19}$ | 950 |
| $3 \times 10^{19}$ | 1800 |
| $10^{19}$ | 2000 |

As shown in Table 4, the threshold voltage sharply increased when the boron concentration was lowered from $5\times10^{19}$ $cm^{-3}$ to $3\times10^{19}$ $cm^{-3}$ in case the columnar part was fabricated to be very thin. This proves that electron emission efficiency is improved when the boron concentration is $5\times10^{19}$ or more in case the columnar part was fabricated to be very thin.

Example 5

A monocrystal diamond substrate produced by a vapor-phase synthesis was doped with boron and nitrogen. The electron emission characteristic of electron emission elements made by using thus doped product was evaluated. As a result, those containing nitrogen were found to have a better electron emission characteristic at a fixed boron concentration.

What is claimed is:

1. An electron emission element comprising a substrate, and a protrusion protruding from the substrate and including boron-doped diamond:

the protrusion comprising a columnar body;

a tip portion of the protrusion comprising an acicular body sticking out therefrom; and the distance r [cm] between a center axis and a side face in the columnar body and the boron concentration Nb [$cm^{-3}$] in the diamond satisfying the relationship represented by the following formula (1):

$$r > \frac{10^4}{\sqrt{Nb}}, \tag{1}$$

wherein the distance r [cm] between the center axis and side face in the columnar body is 0.1 μm or less; and wherein the boron concentration in the diamond is $5\times10^{19}$ $cm^{-3}$ or more.

2. The electron emission element according to claim 1, wherein the protrusion protrudes from a (111) sector of a diamond formed by a high pressure-high temperature synthesis.

3. The electron emission element according to claim 1, wherein the substrate comprises a diamond formed by a vapor-phase synthesis.

4. An electron emission element comprising a substrate, and a protrusion protruding from the substrate and including boron-doped diamond:

the protrusion comprising a columnar body;

a tip portion of the protrusion comprising an acicular body sticking out therefrom;

diamond crystal included in the tip portion of the protrusion being terminated with hydrogen; and the distance r [cm] between a center axis and a side face in the columnar body and the boron concentration Nb [$cm^{-3}$] in the diamond satisfying the relationship represented by the following formula (2):

$$r > \frac{10^2}{\sqrt{Nb}}. \tag{2}$$

5. The electron emission element according to claim 4, wherein the protrusion protrudes from a (311) or (110) sector of a diamond formed by a high pressure-high temperature synthesis.

6. An electron emission element comprising a substrate, and a protrusion protruding from the substrate and including boron-doped diamond:

the protrusion comprising a columnar body;

a tip portion of the protrusion comprising an acicular body sticking out therefrom; and the distance r [cm] between a center axis and a side face in the columnar body and the boron concentration Nb [$cm^{-3}$] in the diamond satisfying the relationship represented by the following formula (1):

$$r > \frac{10^4}{\sqrt{Nb}}, \quad (1)$$

wherein the diamond is doped with nitrogen; and wherein the boron concentration Nb [$cm^{-3}$] in the diamond is higher than the nitrogen concentration Nn [$cm^{-3}$] therein.

7. The electron emission element according to claim 6, wherein the diamond is doped with nitrogen; and wherein the boron concentration Nb [$cm^{-3}$] and nitrogen concentration Nn [$cm^{-3}$] in the diamond satisfy the relationship represented by the following formula (3):

$$Nb - Nn < 6 \times 10^{-18} \quad (3).$$

* * * * *